US005273857A

United States Patent [19]

Neumann et al.

[11] Patent Number: 5,273,857

[45] Date of Patent: Dec. 28, 1993

[54] LASER-INDUCED THERMAL DYE TRANSFER WITH SILVER PLATED COLLOIDS AS THE IP ABSORBER

[75] Inventors: Stephen M. Neumann, Rochester, N.Y.; David C. Shuman, Winter Garden, Fla.

[73] Assignee: Eastman Kodak Company, Rochester, N.Y.

[21] Appl. No.: 980,891

[22] Filed: Nov. 24, 1992

[51] Int. Cl.[5] ..... G03C 8/00; B41M 5/03; B41M 5/26

[52] U.S. Cl. ..... 430/200; 430/201; 430/945; 503/227

[58] Field of Search ..... 430/346, 200, 201, 495, 430/945; 503/227; 346/76 L

[56] References Cited

U.S. PATENT DOCUMENTS 4,004,924 1/1977 Vrancken et al. ..... 430/270
4,477,555 10/1984 Oha et al. ..... 346/76 L
4,804,977 2/1989 Long ..... 346/76 L
4,880,768 11/1989 Mochizuki et al. ..... 503/227
5,034,292 7/1991 Gilmour et al. ..... 430/346
5,034,313 7/1991 Shuman ..... 430/346
5,055,380 10/1991 Bertucci et al. ..... 430/495

FOREIGN PATENT DOCUMENTS 2083726A 3/1982 United Kingdom ..... 117/36

*Primary Examiner*—Charles L. Bowers, Jr.
*Assistant Examiner*—Martin Augebranndt
*Attorney, Agent, or Firm*—Harold E. Cole

[57] ABSTRACT

This invention relates to a dye donor element for laser-induced thermal dye transfer comprising a support having thereon a dye layer comprising an image dye in a binder and an infrared-absorbing material associated therewith, and wherein said infrared-absorbing material is a platelet silver metal colloid having a minimum effective diameter of at least 20 nm.

6 Claims, No Drawings

LASER-INDUCED THERMAL DYE TRANSFER WITH SILVER PLATED COLLOIDS AS THE IP ABSORBER

This invention relates to the use of a metal colloid as the infrared-absorbing material in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In U.S. Pat. No. 5,034,313, there is a disclosure of metastable metal colloids and their preparation. There is no disclosure in that patent, however, that such metal colloids may be used as an infrared-absorbing material in a laser-induced thermal dye transfer system.

In GB 2,083,726A, the absorbing material which is disclosed for use in that laser system is carbon. There is a problem with using carbon as the absorbing material in that it is particulate and has a tendency to clump when coated which may degrade the transferred dye image. Also, carbon may transfer to the receiver by sticking or ablation causing a mottled or desaturated color image. It is an object of this invention to provide an absorbing material which does not have these disadvantages and which also has a greater thermal efficiency or covering power.

These and other objects are achieved in accordance with this invention which relates to a dye donor element for laser-induced thermal dye transfer comprising a support having thereon a dye layer comprising an image dye in a binder and an infrared-absorbing material associated therewith, and wherein the infrared-absorbing material is a platelet silver metal colloid having a minimum effective diameter of at least 20 nm.

The platelet silver metal colloids useful in this invention are described more fully in U.S. Pat. No. 5,034,313, described above, the disclosure of which is hereby incorporated by reference. Examples 1 and 2 of that patent show the preparation of the platelet silver metal colloids useful herein. In a preferred embodiment of the invention, the platelets have a minimum effective diameter of 40 nm and a thickness of less than 10 nm.

In another preferred embodiment of the invention, the platelet silver metal colloid is obtained by electrolessly plating silver on nuclei, such as silver, the nuclei being less than 20 nm in diameter.

The platelet silver metal colloid can be used in the invention at any concentration which is effective for the intended purpose. In general, good results have been obtained at a concentration from about 0.04 to about 0.33 $g/m^2$.

The platelet silver metal colloid used in the invention has a high absorption of infrared light and thus can be used in a smaller amount than other infrared-absorbing materials, i.e, it has greater thermal efficiency. Color purity using these materials is also improved since there is no transfer of undesirable materials such as carbon.

Spacer beads may be employed in a separate layer over the dye layer in order to separate the dye-donor from the dye-receiver thereby increasing the uniformity and density of dye transfer. That invention is more fully described in U.S. Pat. No. 4,772,582. The spacer beads may be coated with a polymeric binder if desired.

To obtain the laser-induced thermal dye transfer image employed in the invention, a diode laser is preferably employed since it offers substantial advantages in terms of its small size, low cost, stability, reliability, ruggedness, and ease of modulation. By using the infrared-absorbing material, the laser radiation is absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared absorbing dye may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/M from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

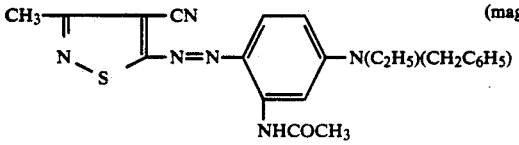
(magenta)

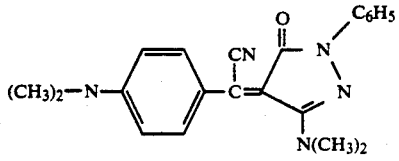
(magenta)

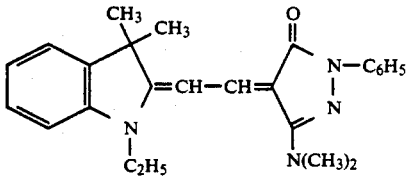
(yellow)

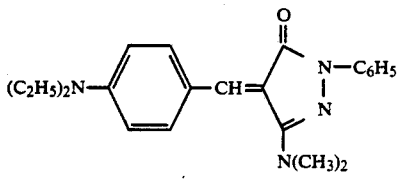
(yellow)

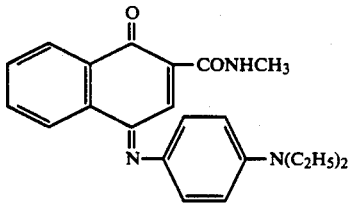
(cyan)

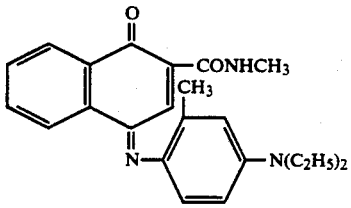
(cyan)

or any of the dyes disclosed in U.S. Pat. Nos. 4,541,830. 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone), a poly(phenylene oxide) or a hydrophilic binder such as polyvinyl alcohol or gelatin. The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention usually comprises a support having thereon a dye image-receiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek ®. In a preferred embodiment, an injection-molded polycarbonate support is employed.

The dye image-receiving layer may comprise, for example, a polycarbonate, a polyester, cellulose esters, poly(styrene-co-acrylonitrile), poly-caprolactone or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer in a binder having an infrared-absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following example is provided to illustrate the invention.

EXAMPLE

An infrared-absorbing colloidal silver sol was prepared as described in Example 1 of U.S. Pat. No. 5,034,313.

Dye dispersions to be used in this Example were prepared as follows:

TABLE I

| Dye Dispersion | |
|---|---|
| COMPONENT | QUANTITY (grams) |
| Cyan, Magenta or Yellow Dye | 250 |
| 18.2% aq. Triton ® X-200 A2 Dispersing Agent | 275 |
| Distilled Water | 476 |

The formulation, as shown in Table I, was milled at 16° C. in a 1-liter media mill (Model LME1, Netzsch Inc.) filled to 75% by volume with 0.4 to 0.6 mm zirconia silica medium (obtainable from Quartz Products Corp., SEPR Division, Plainfield N.J.). The slurry was milled until a mean near infrared turbidity measurement indicated the particle size to have been less than or equal to 0.2 μm by discrete wavelength turbidimetry. This corresponded to a milling residence time of 45–90 minutes.

An aqueous carbon black (infrared-absorbing species) dispersion was prepared according to the formulation shown in Table II.

TABLE II

| Carbon Black Dispersion | |
|---|---|
| COMPONENT | QUANTITY (grams) |
| Carbon Black (Black Pearls 430 from Cabot Chemical Co.) | 200 |
| 18.2% aq. Triton ® X-200 A2 Dispersing Agent | 165 |
| Distilled Water | 635 |

Individual dye-donor elements were prepared by simultaneously coating each of the following multilayer structures from water on a 100 μm gel subbed poly(ethylene terephthalate) support:

a) a yellow dye layer comprising the dye dispersion described above (0.44 g/m$^2$), using the second yellow dye illustrated above, the silver sol described above (0.11 g/m$^2$), gelatin (0.11 g/m$^2$) and Fluortenside FT-248 ® surfactant (tetraethylammonium perfluoro-octylsulfonate) (Bayer Company) at 0.007 g/m$^2$ coated simultaneously over a layer of gelatin (1.61 g/m$^2$) and spacer beads of poly(divinyl-benzene) (9 μm average particle diameter) (0.02 g/m$^2$), which was itself coated simultaneously over a layer of gelatin (3.77 g/m$^2$) and the gelatin cross-linking agent 1,1'-[methylenebis(sulfonyl)] bisethene (0.054 g/m$^2$).

b) a magenta dye layer comprising the dye dispersion described above (0.57 g/m$^2$), using the first magenta dye illustrated above, the silver sol described above (0.11 g/m$^2$), gelatin (0.11 g/m$^2$) and Fluortenside FT-248 ® surfactant (tetraethylammonium perfluorooctylsulfonate) (Bayer Company) at 0.007 g/m$^2$ coated simultaneously over a layer of gelatin (1.61 g/m$^2$) and spacer beads of poly(divinylbenzene) (9 μm average particle diameter) (0.02 g/m$^2$), which was itself coated simultaneously over a layer of gelatin (3.77 g/m$^2$) and the gelatin cross-linking agent 1,1'-[methylenebis(sulfonyl)] bisethene (0.054 g/m$^2$).

c) a cyan dye layer comprising the dye dispersion described above (0.78 g/m$^2$), using the second cyan dye illustrated above, the silver sol described above (at 0.11 g/m$^2$), gelatin (at 0.11 g/m$^2$) and Fluortenside FT-248 ® surfactant (tetraethylammonium perfluorooctylsulfonate) (Bayer Company) at 0.007 g/m$^2$ coated simultaneously over a layer of gelatin (1.61 g/m$^2$) and spacer beads of polydivinylbenzene (9 μm average particle diameter) (0.02 g/m$^2$), which was itself coated simultaneously over a layer of gelatin (3.77 g/m$^2$) and the gelatin cross-linking agent 1,1'-[methylenebis-(sulfonyl)] bisethene (0.054 g/m$^2$).

Control dye donor elements were prepared as described above replacing the silver sol with the above described carbon dispersion (at 0.22 g/m$^2$).

The dye-image receiving elements used were thick slabs of polycarbonate prepared as described in U.S Ser. No. 722,810, of Sarraf, et al., filed Jun. 28, 1991.

Single color dye images were produced as described below by printing the dye-donor sheets described above onto the dye receiver using a laser imaging device similar to the one described in U.S. Ser. No. 457,595 of Sarraf et al, filed Dec. 27, 1989, entitled "Thermal Slide Laser Printer". The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage whose position was controlled by a lead screw which determined the y-axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mWatts at the platen. The measured spot size of the laser beam was an oval of nominally 7 by 9 μm (with the long dimension in the direction of the laser beam sweep). The center-to-center line distance was 8.94 μm (3290 lines per inch) with a laser scanning speed of 26.9 Hz.

The imaging electronics were activated and the modulated laser beam scanned the dye-donor to transfer dye to the dye-receiver. After imaging, the dye receiver was removed from the platen and the image dyes were fused into the receiver by white light irradiation for 50 seconds.

The visible spectrum of each colored image was measured by visible spectrophotometry using air as the reference. The density in a region of the spectrum where the dye itself does not absorb (taken as a measure of undesirable neutral material transfer or color contamination) was as follows:

TABLE 3

| Donor | IR Material | Wavelength of Measurement for Color Contamination (nm) | Density at "Off Peak" Wavelength | Improvement in Light Transmission (Silver Relative to Carbon) |
|---|---|---|---|---|
| Yellow | Silver Sol | 650 | −0.009 | 16.2% |
| Yellow | Carbon | 650 | 0.068 | |
| Magenta | Silver Sol | 750 | −0.001 | 7.1% |
| Magenta | Carbon | 750 | 0.031 | |
| Cyan | Silver Sol | 450 | 0.030 | 12.3% |
| Cyan | Carbon | 450 | 0.087 | |

The data in the last column reflect the increased amount of light transmitted in non-dye absorbing areas when silver is used as the infrared-absorbing material. Since ideally light is only absorbed by image dye in an imaging system, these increases in light transmittance constitute substantial improvements in color purity by elimination of unwanted absorption.

The invention has been described in detail with particular reference to preferred embodiments thereof, but it will be understood that variations and modifications can be effected within the spirit and scope of the invention.

What is claimed is:

1. In a dye donor element for laser-induced thermal dye transfer comprising a support having thereon a dye layer comprising a sublimable image dye and an infrared-absorbing material in a binder, the improvement wherein said infrared-absorbing material is a non-spherical, platelet silver metal colloid, said colloid being obtained by electrolessly plating silver on nuclei less than 20 nm in diameter.

2. The element of claim 1 wherein said nuclei are silver.

3. In a process of forming a laser-induced thermal dye transfer image comprising:

a) contacting at least one dye-donor element comprising a support having thereon a dye layer comprising a sublimable image dye and an infrared-absorbing material in a binder, with a dyer-receiving element comprising a support having thereon a polymeric dye image-receiving layer;

b) imagewise-heating said dye-donor element by means of a laser; and c) transferring a dye image to said dye-receiving element to form said laser-induced thermal dye transfer image, the improvement wherein said infrared-absorbing material is a non-spherical, platelet silver metal colloid, said colloid being obtained by electrolessly plating silver on nuclei less than 20 nm in diameter.

4. The process of claim 3 wherein said nuclei are silver.

5. In a thermal dye transfer assemblage comprising:

(a) a dye donor element comprising a support having thereon a dye layer comprising a sublimable dye and an infrared-absorbing material dispersed in a binder, and (b) a dye-receiving element comprising a support having thereon a dye image-receiving layer, said dye-receiving element being in superposed relationship with said dye-donor element so that said dye layer is in contact with said dye image-receiving layer, the improvement wherein said infrared-absorbing material is a non-spherical, platelet silver metal colloid, said colloid being obtained by electrolessly plating silver on nuclei less than 20 nm in diameter.

6. The assemblage of claim 5 wherein said nuclei are silver.

* * * * *